US008066822B2

(12) United States Patent
Ahn

(10) Patent No.: US 8,066,822 B2
(45) Date of Patent: Nov. 29, 2011

(54) DISH WASHING MACHINE HAVING A STEAM GENERATOR AND AN OVER-PRESSURE PREVENTION FEATURE

(75) Inventor: In Geun Ahn, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 883 days.

(21) Appl. No.: 12/071,291

(22) Filed: Feb. 19, 2008

(65) Prior Publication Data

US 2008/0308136 A1 Dec. 18, 2008

(30) Foreign Application Priority Data

Jun. 18, 2007 (KR) ..... 10-2007-0059317

(51) Int. Cl.
*B08B 7/04* (2006.01)
*B08B 3/00* (2006.01)

(52) U.S. Cl. ..... 134/56 D; 134/105; 134/200

(58) Field of Classification Search ..... 134/56 D, 134/57 D, 58 D, 103.2, 105, 172, 178, 184, 134/186, 200
See application file for complete search history.

(56) References Cited

U.S. PATENT DOCUMENTS

| | | | | |
|---|---|---|---|---|
| 5,337,703 | A * | 8/1994 | Schlesch et al. | 122/379 |
| 7,690,062 | B2 * | 4/2010 | Pinkowski et al. | 8/158 |
| 7,763,118 | B2 * | 7/2010 | Pyo et al. | 134/56 D |
| 2005/0034489 | A1 * | 2/2005 | Oh et al. | 68/5 C |
| 2007/0102025 | A1 * | 5/2007 | Ahn et al. | 134/25.2 |
| 2007/0235063 | A1 * | 10/2007 | Lee et al. | 134/25.2 |
| 2007/0283509 | A1 * | 12/2007 | Wong et al. | 8/149.3 |
| 2007/0283728 | A1 * | 12/2007 | Wong et al. | 68/5 R |
| 2008/0236624 | A1 * | 10/2008 | Kim et al. | 134/18 |
| 2008/0236625 | A1 * | 10/2008 | Kim et al. | 134/18 |
| 2008/0250822 | A1 * | 10/2008 | Ahn | 68/5 C |
| 2008/0271500 | A1 * | 11/2008 | Ahn | 68/5 C |

FOREIGN PATENT DOCUMENTS

| | | | |
|---|---|---|---|
| DE | 102006025150 | A1 | 12/2006 |
| DE | 102006025152 | A1 | 12/2006 |
| EP | 1759623 | A1 | 3/2007 |
| KR | 2006-95724 | * | 9/2006 |
| KR | 2006-124284 | * | 12/2006 |

* cited by examiner

*Primary Examiner* — Joseph L Perrin
(74) *Attorney, Agent, or Firm* — McKenna Long & Aldridge LLP

(57) ABSTRACT

Dish washing machine including a steam generator. The dish washing machine also includes a tub that defines a dish washing space therein. A water supply supplies water to the steam generator, and a steam flow conduit guides steam, generated by the steam generator, to the dish washing space. An over-pressure prevention conduit having one end connected to the water supply conduit and the other end connected to either the steam flow conduit or the tub. The over-pressure prevention conduit prevents water in the steam generator from flowing backward into the water conduit and/or the public water supply when a reverse water pressure condition occurs.

9 Claims, 5 Drawing Sheets

DISH WASHING MACHINE HAVING A STEAM GENERATOR AND AN OVER-PRESSURE PREVENTION FEATURE

This application claims the benefit of Korean Patent Application No. 10-2007-0059317, filed on Jun. 18, 2007, which is hereby incorporated by reference in its entirety as if fully set forth herein.

BACKGROUND OF THE INVENTION

1. Field of the Invention

The present invention relates to a dish washing machine that includes a steam generator. More specifically, the present invention relates to a dish washing machine that is capable of preventing over-pressure conditions in the steam generator due, for example, to a clog or blockage in the steam conduit.

2. Discussion of the Related Art

Generally, dish washing machines are well known as devices that automatically wash dishes in the washing compartment of the dish washing machine by spraying wash water, under high pressure, on the dishes, thus, removing foreign matter such as food particles and food residues attached to the surface of the dishes. It is understood that dish washing machine's wash items other than dishes, such as glassware, pots, pans, utensils and the like. However, for ease of discussion, the following disclosure will refer only to dishes.

One important factor associated with dish washing machines is how effectively the machine removes food particles and food residues on or attached to the surface of dishes. In order to improve washing capability, dish washing machines increase the force (i.e., the spray pressure) of the wash water to more effectively remove foreign matter form the surface of the dishes. However, if the spray pressure of the wash water is too high, the dishes may break or otherwise become damaged. Further, when washing dishes with increased spray pressure, the dish washing operation is less efficient because the amount of wash water required increases.

SUMMARY OF THE INVENTION

Accordingly, the following disclosure describes a dish washing machine that obviates one or more of the problems associated with the related art. More specifically, described herein is a dish washing machine that includes a steam generator, where the dish washing machine safely, effectively and efficiently washes dishes without having to employ excessive spray pressure or an excessive amount of wash water. Still further, the following disclosure describes a dish washing machine that is capable of avoiding over-pressure in the steam generator due, for example, to a clog or blockage in the steam generator or the conduits associated therewith.

Various advantages, objects, and features of the invention will be set forth in part in the written description and drawings that follow. Other advantages, objectives and features will become apparent to those having ordinary skill in the art based on the following description and drawings and/or from practicing the invention.

In accordance with one aspect of the present invention, the aforementioned advantages and objects are achieved by a dish washing machine that includes a tub that defines a washing space therein. The dish washing machine also includes a steam generator that generates steam for the washing space during a washing operation, a water supply conduit connected to the steam generator for supplying water to the steam generator, and a steam flow conduit connected to the steam generator which guides the steam generated by the steam generator into the washing space. The dish washing machine further includes a backflow prevention conduit having a first end and a second end, the first end connected to the water supply conduit and the second end connected to the steam flow conduit.

In accordance with another aspect of the present invention, the aforementioned advantages and objects are achieved by a dish washing machine that includes a tub that defines a washing space therein. The dish washing machine also includes a steam generator that generates steam for the washing space during a washing operation, a water supply conduit connected to the steam generator for supplying water to the steam generator, and a steam flow conduit connected to the steam generator which guides the steam generated by the steam generator into the washing space. The dish washing machine further includes a backflow prevention conduit having a first end and a second end, the first end connected to the water supply conduit and the second end connected to the tub.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate various exemplary embodiments of the invention, and together with the description, serve to explain the principle of the invention. In the drawings.

DETAILED DESCRIPTION OF THE INVENTION

Reference will now be made in detail to exemplary embodiments of the present invention, which are illustrated in the accompanying drawings. Wherever possible, the same reference numbers will be used throughout the drawings to refer to the same or like parts.

Figure 1:
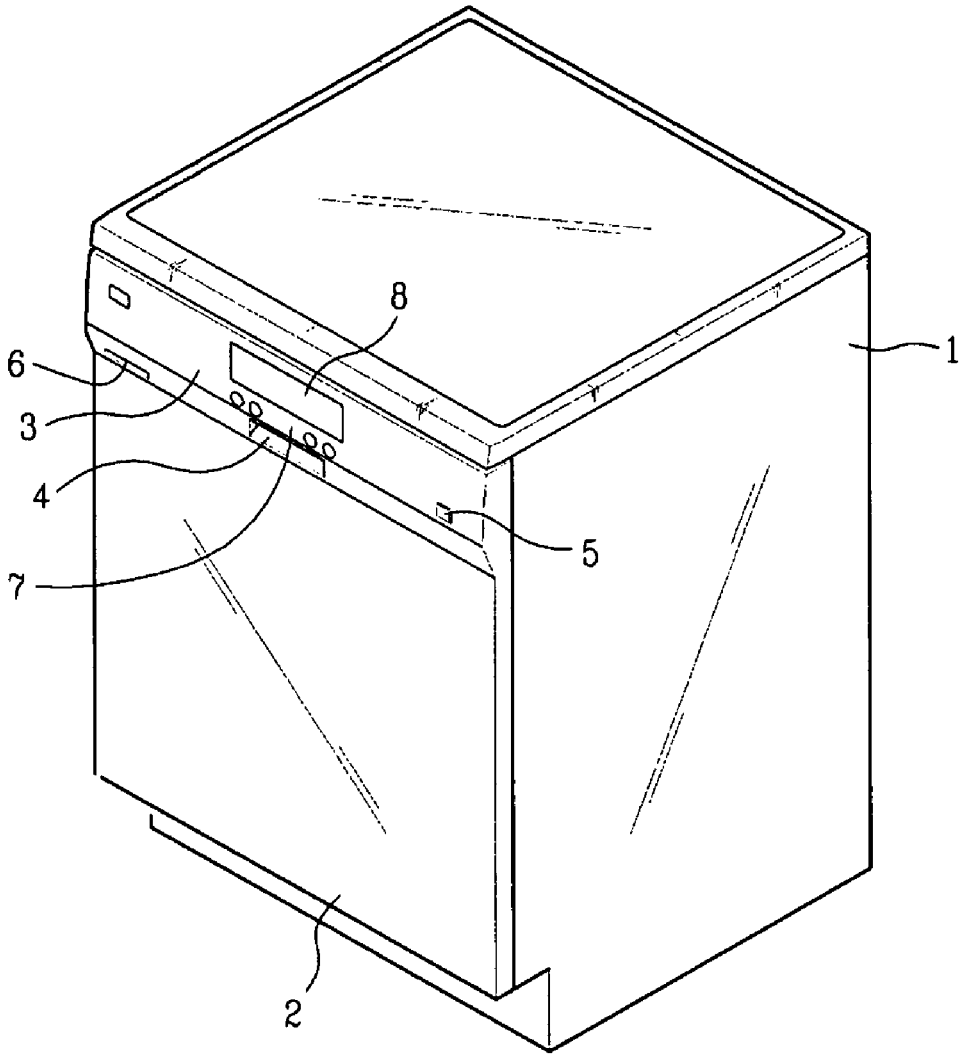
FIG. 1 is a perspective view of a dish washing machine according to exemplary embodiments of the present invention; embodiments of the present invention.

FIG. 1 is a perspective view of a dish washing machine according to exemplary embodiments of the present invention. The dish washing machine includes a case 1 which defines the external appearance of the dish washing machine. Case 1 is open in front to accommodate a door 2. In the exemplary embodiment of FIG. 1, the door 2 includes a door grip 4, to aid in opening the door 2. The door 2 further includes a steam discharge port 6 which permits high-temperature air and/or steam to be discharged from inside the dish washing machine. Still further, the door 2 includes a control panel 3.

The control panel 3 includes, among other things, a power switch 5 for turning on/off the dish washing machine; a function selection part 7, which the user employs to select and initiate a desired dish washing operation; and a display part 8 for displaying the operational state of the dish washing machine.

Figure 2:
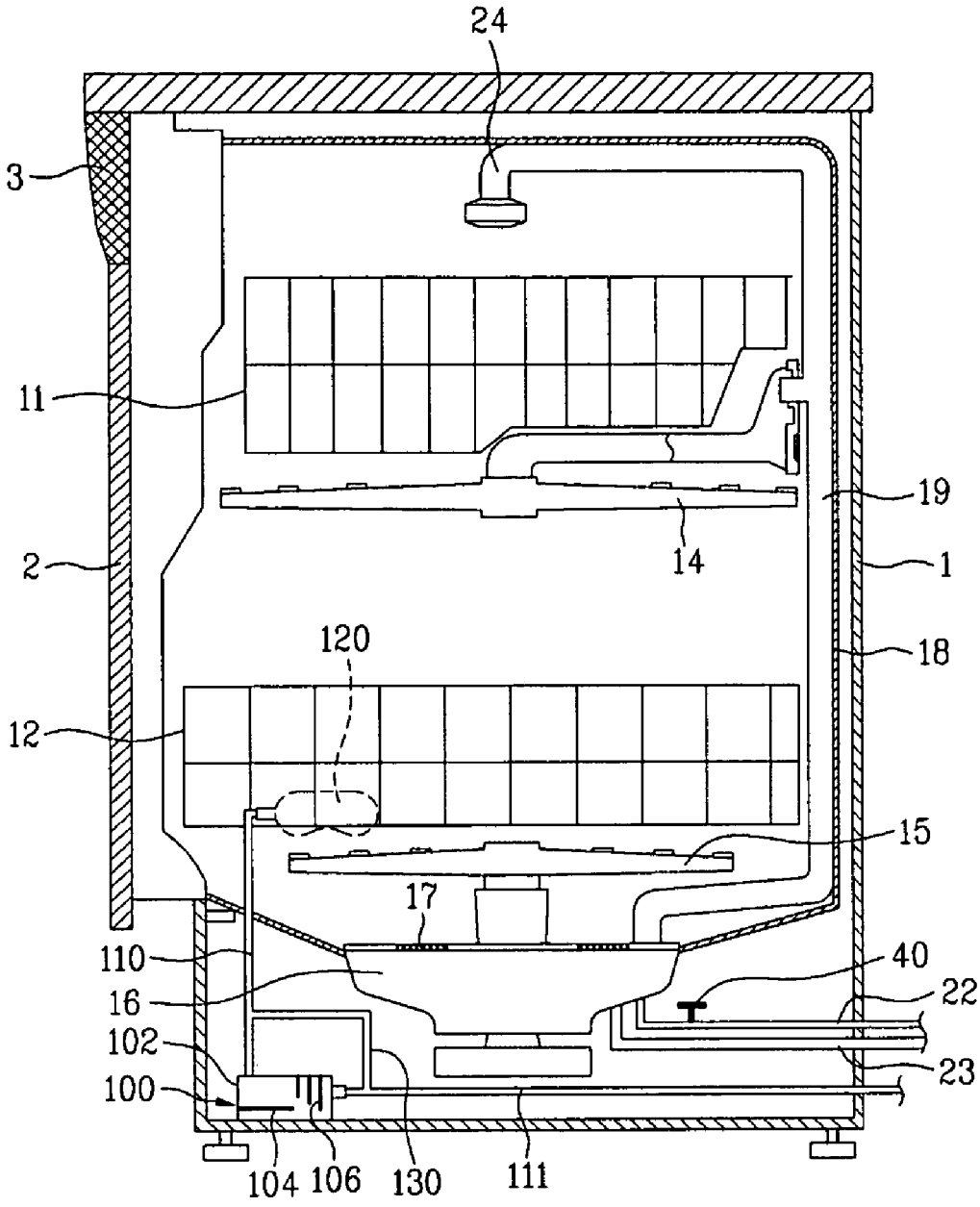
FIG. 2 is a vertical, sectional view of a the dish washing machine according to exemplary embodiments of the present invention.

FIG. 2 is a vertical, sectional view of a dish washing machine in accordance with exemplary embodiments of the present invention. The dish washing machine includes a tub 18 mounted in the case 1. The tub 18 defines a dish washing compartment or space. A filter 17 filters the wash water by removing food particles and other waste from the wash water. The filtered wash water is then collected in a sump 16, which is mounted at the bottom of the tub 18. Filtering and, thereafter, collecting the wash water allows the wash water to be repeatedly re-circulated during a dish washing operation.

Sump 16 may include a pump (not shown). The pump would be used to pump the filtered wash water back into the washing space. Else, the wash water is discarded through a water drainage conduit 23.

The sump 16 may further include a heater. The heater may be used to heat the wash water collected in the sump 16. Heating the wash water generally makes the detergent more effective. Heated water, regardless of the detergent, is known to be more effective in soaking and dissolving food and/or food residue on the dishes.

Still referencing FIG. 2, one or more racks, such as racks 11 and 12 are disposed at the upper and lower portions of the dish washing space, respectively. As shown spray arms 24, 14, and 15 spray wash water toward the respective racks 11 and 12. A wash water flow conduit 19 is used for supplying wash water to the upper spray arms 14 and 24.

The dish washing machine, according to exemplary embodiments of the present invention further includes a steam generator 100. Steam from the steam generator 100, is supplied to the dish washing space. A steam flow conduit 110 may be used to supply the steam to the dish washing space, as shown. At least one steam nozzle 120 may be used to introduce the steam into the dish washing space.

In the exemplary embodiment shown in FIG. 2, the steam generator 100 is mounted below the tub 18. As such, the steam is easily supplied to the dish washing space. This is because steam is lighter than air and, therefore, the steam generated by steam generator 100 tends to rise upward through the steam flow conduit 110 and into the dish washing space through the steam nozzle 120. However, the present invention is not limited to the position of the steam generator 100, illustrated in FIG. 2. Alternatively, the steam generator 100 may be mounted at the side of tub 18.

Steam generator 100, as shown, includes a case 102. Inside case 102 there is a space for receiving water. Case 102 also is adapted to receive a heater 104, which heats the water in the space formed by case 102. The steam generator 100 also includes a water level sensor 106 for detecting the level of the water contained therein, and a fuse (not shown) for preventing the heater 104 from overheating.

The dish washing machine as illustrated in FIG. 2 includes a water supply conduit 22. This conduit carries water from an external water source to the sump 16 and eventually to the dish washing space. The dish washing machine also includes a water drainage conduit 23 for draining dirty wash water after the wash water is used to wash the dishes. Still further, the washing machine includes a tub valve 40, which is mounted on the water supply conduit 22 to control the amount of water supplied through the water supply conduit 22.

In the exemplary embodiment of FIG. 2, water is supplied to the steam generator 100 through the steam generator water supply conduit 111. The steam generator water supply conduit 111 may be directly connected to an external water supply (not shown) or to the water supply conduit 22 (connection not shown).

The operation of the dish washing machine, illustrated in FIG. 2, will be described in brief by way of example. First, dishes are placed on racks 11 and 12 and door 2 is closed. The user then makes the desired selection using the function selection part 7 on control panel 7 to initiate the operation of the dish washing machine. During the dish washing operation, the operational state of the dish washing machine is displayed on display part 8.

The flow sequence of the wash water will now be described. The wash water is sprayed from spray arms 14, 15 and 24 in the direction of racks 11 and 12. The wash water eventually drops downward through filter 17 and into the sump 16. The pump mounted in the sump 16 pumps (i.e., recirculates the wash water at a given pressure back into spray arms 14, 15, and 24). When steam is used, the steam generator 100 supplies steam to the dish washing space through the steam flow conduit 110 and the steam nozzle 120.

As previously stated, filter 17 removes food debris from the wash water. Consequently, food particles are prevented from blocking the spray arms 14, 15 and 24 as well as nozzle.

In general, steam improves the washing efficiency and effectiveness of the dish washing machine. The high-temperature and high-humidity characteristics associated with steam also allow moisture to more effectively soak into and loosen food residue on the dishes. Then when high-pressure wash water is sprayed on the dishes, the food residue is more easily removed compared to washing dishes with high-pressure wash water alone.

When the steam generator water supply conduit 111 is directly connected to a water source (not shown), or indirectly connected to the water source through water supply conduit 22, it is important to prevent the water in the steam generator 100 from flowing backward toward the water source. In general, water is supplied to a home or facility at a relatively constant, predetermined water pressure range. However, if the pressure at the receiving end of the water supply conduit becomes greater than the pressure of the supplied water, it is possible for water to flow into the water supply conduit, backward toward the water supply. An increase in pressure at the receiving end may, for example, result from a blockage (e.g., a clog) in the steam flow conduit 110 or the steam nozzle 120, or for various other reasons. Upon such an occurrence, water in the steam generator 100 may flow backward into the steam generator water supply conduit 111 and, eventually, into the public water supply.

Water in the steam generator 100 can, over time, become contaminated with high concentrations of impurities such as calcium, which may precipitate out of the water in the form of calcium hydrocarbonate (i.e., lime). Thus, the backward flow of water may contaminate clean water in the water supply conduit, which is not desirable. If the backflow pressure is relatively high, the contaminated water may, as previously stated, flow all the back into the public water supply. Consequently, it is desirable, and most countries legally require, that home appliances directly connected to a public water supply, have the ability to prevent water from flowing backward into the water supply conduit, when the reverse water pressure is greater than the supply water pressure.

Solutions preventing backflow when the reverse water pressure is greater than the supply water pressure can significantly increase manufacturing costs. Thus, a more economical solution is desirable. To this end, a dish washing machine according to exemplary embodiments of the present invention further include a backflow prevention conduit 130, as illustrated in FIG. 2, having one end connected to the steam generator water supply conduit 111 and the other end connected to the steam flow conduit 110.

As shown, the backflow prevention conduit 130 joins the water supply side of the steam generator 100 to the dish washing space (via the steam nozzle 120 or another opening (not shown). When the reverse water pressure in the steam generator 100 is greater than the supply water pressure, the relatively higher pressure steam and water in the steam generator 100 flows through the backflow prevention conduit 130 and into the dish washing space, because pressure in the dish washing space is less than the pressure of the water flowing into the steam generator 100 from the steam generator water supply conduit 111. As a result, the backward flow of water, from the steam generator 100 into the steam generator water supply conduit 111, is averted. Moreover, the backflow prevention conduit 130 offers a solution to the reverse water pressure, backflow problem that is relatively inexpensive with respect to manufacturing cost.

Figure 3:
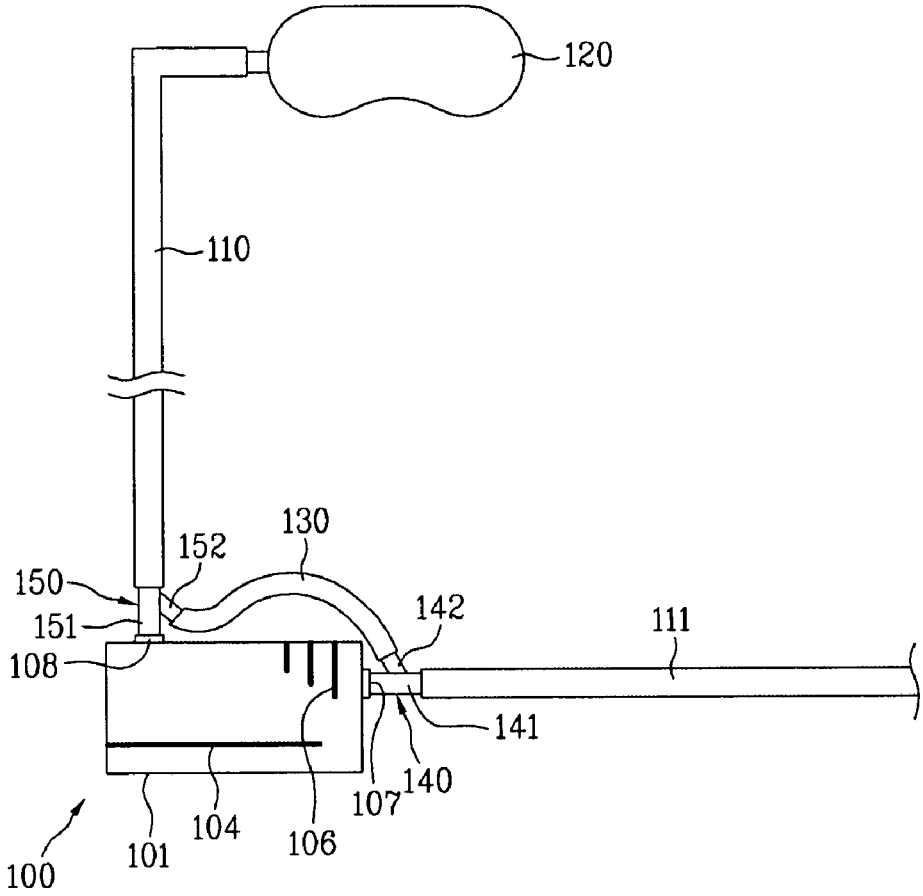
FIG. 3 is schematic view of a backflow prevention conduit according to one exemplary embodiment of the present invention.

FIG. 3 is a schematic illustrating a backflow prevention conduit in accordance with one exemplary embodiment of the present invention. In accordance with this exemplary embodiment, a first connection part 140 connects the backflow prevention conduit 130 steam generator water supply conduit 111. A second connection part 150 connects the backflow prevention conduit and the steam flow conduit 110. The first connection part 140 and the second connection part 150 may, for example, be branch type connection conduits, as shown. In this case, the connection between the backflow prevention conduit 130 and the steam generator water supply conduit 111 and the connection between the backflow prevention conduit 130 and the steam flow conduit 110 may be easily and conveniently accomplished. Specifically, the first connection part 140 may include a first main conduit 141 and a first sub-conduit 142 connected to the side of the first main conduit 141. Likewise, the second connection part 150 may include a second main conduit 151 and a second sub-conduit 152 connected to the side of the second main conduit 151.

In accordance with this exemplary embodiment, the first main conduit 141 is connected at one end to a water supply port 107 of the steam generator 100 and, at the other end, to the steam generator water supply conduit 111. The first sub-conduit 142 is connected to the backflow prevention conduit 130. The second main conduit 151 is connected at one end to a steam discharge port 108 of the steam generator 100 and, at the other end, to the steam flow conduit 110. The second sub-conduit 152 is connected to the backflow prevention conduit 130.

Further, in accordance with this exemplary embodiment, and as illustrated in FIG. 3, the first sub-conduit 142 may diverge upward from the first main conduit 141. This prevents the water supplied to the steam generator 100 from the steam generator water supply conduit 111 from entering the backflow prevention conduit 130. However, if there is backflow due to reverse water pressure, the steam will flow through the water supply port 107 into the backflow prevention conduit 130. This is because steam tends to move upward, whereas water tends to move downward. The steam may eventually flow from the backflow prevention conduit 130 into the steam flow conduit 110.

As shown, the water supply port 107 is, in this exemplary embodiment, disposed in the upper part of the case 101. This facilitates the flow of steam through the water supply port 107, into the first connection part 140, and then into the backflow prevention conduit 130. At the same time, it helps to prevent residual water in the bottom of the steam generator 100 from flowing into the steam generator water supply conduit 111.

The second sub-conduit 152 preferably diverges downward from the second main conduit 151, as shown in FIG. 2. In this case any steam flowing through the steam flow conduit 110 tends to continue flowing upward toward the dish washing space and not downward, into the backflow prevention conduit 130.

Turning our attention back to the first connection part 140, the first sub-conduit 142 is preferably inclined at a predetermined angle in a direction that is the same or substantially the same as the direction of the normal flow of water through the steam generator water supply conduit 111 and into steam generator 100, as shown, for example, in FIG. 2. If, as in this case, the backflow prevention conduit 130 is connected to the steam generator water supply conduit 111 via the first sub-conduit 142, where the angle formed by the first main conduit 141 and the first sub-conduit 142 is relatively small, the air in the backflow prevention conduit 130 will more easily flow into the steam generator water supply conduit 111 when an over-pressure condition occurs. Consequently, the backward flow of the water from the steam generator 100 is further prevented.

If the first sub-conduit 142 is inclined at an angle in a direction opposite to the normal flow of water, the air in the backflow prevention conduit 130 will not flow smoothly into the steam generator water supply conduit 111 when there is reverse water pressure. This is because the direction of the air flow must change such that the air in the backflow prevention conduit 130 flows to the steam generator water supply conduit 111.

Figure 4:
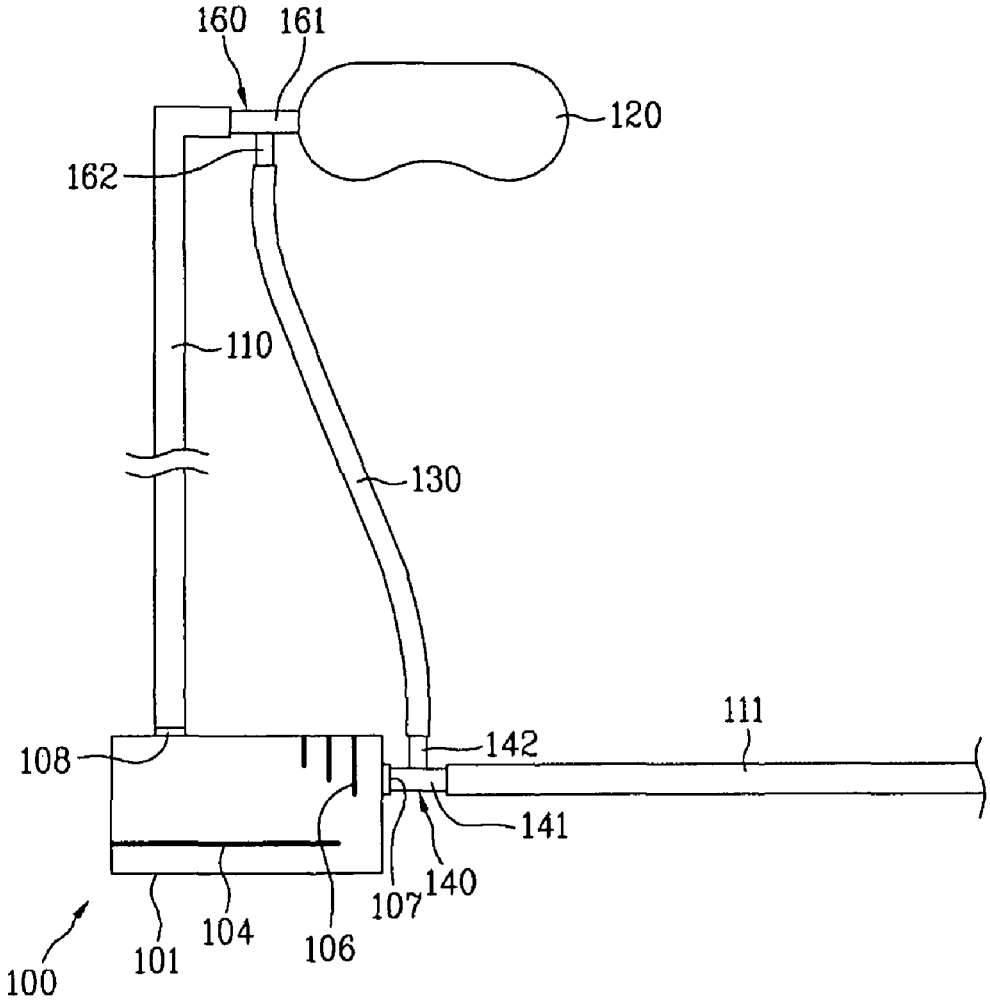
FIG. 4 is a schematic view of a backflow prevention conduit according to another exemplary embodiment of the present invention.

FIG. 4 is a schematic illustrating a backflow prevention conduit in accordance with another exemplary embodiment of the present invention. The backflow prevention conduit according to this exemplary embodiment is different from the backflow prevention conduit according to the previous exemplary embodiment in that the second connection part 160 is located in a different position compared to the second connection part 150. Otherwise, the components associated with the second connection part 160 are the same or similar to the components associated with the second connection part 150.

With reference to FIG. 4, the second connection part 160 includes a second main conduit 161 between the steam flow conduit 110 and an inlet port 118 of the steam nozzle 120. The second connection part 160 also includes a second sub-conduit 162 which connects the second main conduit 161 to the backflow prevention conduit 130. Preferably, the backflow prevention conduit 130 extends substantially in a vertical direction. In this case, the air in the backflow prevention conduit 130 will easily flow into the steam generator water supply conduit 111, when there is reverse water pressure. In addition, the steam passing through the water supply port 107 is easily introduced into the nozzle 120 through the backflow prevention conduit 130.

Figure 5:
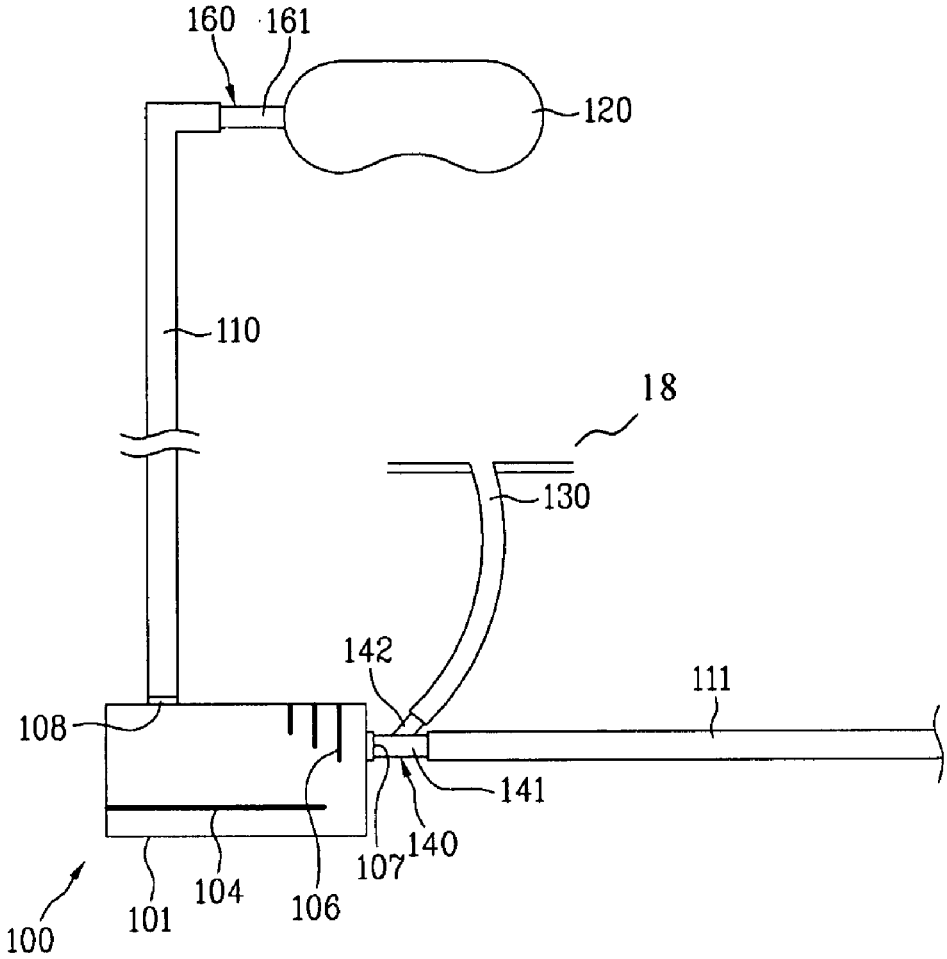
FIG. 5 is a schematic view of a backflow prevention conduit according to still another exemplary embodiment of the present invent.

FIG. 5 is a schematic illustrating a backflow prevention conduit in accordance with still another exemplary embodiment of the present invention. The backflow prevention conduit 130 according to this exemplary embodiment differs from the backflow prevention conduits according to the previous exemplary embodiments in that backflow prevention conduit 130 opens directly into the dish washing space through the wall of tub 18. The backflow prevention conduit 130 may attach to the tub 18 in any conventional manner. Otherwise, the first connection part 140, in accordance with this exemplary embodiment is the same as described above for the two previous exemplary embodiments, as illustrated in FIGS. 3 and 4.

It will be apparent to those skilled in the art that modifications and variations of the present invention are possible without departing from the spirit of and/or scope of the present invention. Thus, it is intended that present invention covers these modifications and variations provided they come within the scope of the appended claims and their equivalence.

What is claimed is:

1. A dish washing machine comprising:

a tub defining a washing space therein;

a steam generator generating steam during a washing operation;

a water supply conduit connected to the steam generator supplying water to the steam generator;

a steam flow conduit connected to the steam generator to guide steam generated by the steam generator into the washing space;

a backflow prevention conduit having a first end and a second end, the first end connected to the water supply conduit and the second end connected to the steam flow conduit, a first connection part having a first port, a second port and a third port, the first port connected to the water supply conduit, the second port connected to the steam generator, and the third port connected to the first end of the backflow prevention conduit; and a second connection part having a first port, a second port and a third port, the first port connected to the steam flow conduit, the second port connected to the steam generator, and the third port connected to the backflow prevention conduit, wherein the first connection part includes:

a main conduit, wherein the first and second ports are located at opposite ends of the main conduit; and a sub-conduit, wherein a first end of the sub-conduit is connected to the main conduit and the third port is located at the opposite end of the sub-conduit, and wherein the sub-conduit diverges upward from the main conduit at a predefined angle with respect to the main conduit.

2. The dish washing machine according to claim 1, wherein the first sub-conduit is inclined at a predetermined angle in a direction that is the same or substantially the same as the direction of the normal flow of water through the steam generator water supply conduit and into steam generator.

3. The dish washing machine according to claim 1, wherein the second connection part includes:

a main conduit, wherein the first and second ports are located at opposite ends of the main conduit; and a sub-conduit, wherein a first end of the sub-conduit is connected to the main conduit and the third port is located at the opposite end of the sub-conduit.

4. The dish washing machine according to claim 3, wherein the sub-conduit diverges downward from the main conduit.

5. The dish washing machine according to claim 1 further comprising:

a steam nozzle through which steam is introduced into the washing space.

6. The dish washing machine according to claim 5, wherein the second connection part includes:

a main conduit, wherein the first and second ports are located at opposite ends of the main conduit; and a sub-conduit, wherein a first end of the sub-conduit is connected to the main conduit and the third port is located at the opposite end of the sub-conduit.

7. The dish washing machine according to claim 6, wherein the sub-conduit diverges downward from the main conduit.

8. A dish washing machine comprising:

a tub defining a washing space therein;

a steam generator generating steam during a washing operation;

a water supply conduit having a first end connected to the steam generator, the water supply conduit supplying water to the steam generator;

a steam flow conduit connected to the steam generator to guide steam generated by the steam generator into the washing space;

a backflow prevention conduit connected to the water supply conduit, wherein the backflow prevention conduit introduces air to the water supply conduit if the pressure at the first end of the water supply conduit is greater than the pressure of the water being supplied to the steam generator;

a first connection part configured to connect the water supply conduit, the steam generator and the backflow prevention conduit; and a second connection part configured to connect the steam flow conduit, the steam generator and the backflow prevention conduit, wherein a port of the first connection part connected to the backflow prevention conduit is formed on an upper portion of the first connection part.

9. A dish washing machine comprising:

a tub defining a washing space therein;

a steam generator generating steam during a washing operation;

a water supply conduit having a first end connected to the steam generator, the water supply conduit supplying water to the steam generator;

a steam flow conduit connected to the steam generator to guide steam generated by the steam generator into the washing space;

a steam nozzle through which steam is introduced into the washing space;

a backflow prevention conduit connected to the water supply conduit, wherein the backflow prevention conduit introduces air to the water supply conduit if the pressure at the first end of the water supply conduit is greater than the pressure of the water being supplied to the steam generator;

a first connection part configured to connect the water supply conduit, the steam generator and the backflow prevention conduit; and a second connection part configured to connect the steam flow conduit, the steam generator and the steam nozzle, wherein a port of the first connection part connected to the backflow prevention conduit is formed on an upper portion of the first connection part.

* * * * *